United States Patent [19]

Schulz et al.

[11] 4,195,986

[45] Apr. 1, 1980

[54] SELECTIVE REDUCTION OF NICKEL LATERITE ORES

[75] Inventors: Jerry D. Schulz, Waukesha; Bobby P. Faulkner, New Berlin, both of Wis.

[73] Assignee: Allis-Chalmers Corporation, Milwaukee, Wis.

[21] Appl. No.: 949,394

[22] Filed: Oct. 6, 1978

[51] Int. Cl.[2] ..... C22B 23/00

[52] U.S. Cl. ..... 75/82; 75/3; 75/31; 75/256

[58] Field of Search ..... 75/82, 3, 31, 256

[56] References Cited

U.S. PATENT DOCUMENTS

| | | | |
|---|---|---|---|
| 3,503,735 | 3/1970 | Beggs et al. | 75/82 |
| 4,049,444 | 9/1977 | Bell et al. | 75/82 |

*Primary Examiner*—M. J. Andrews

*Attorney, Agent, or Firm*—James R. Custin; Arthur M. Streich

[57] ABSTRACT

To prepare nickel laterite ore for selective reduction of its nonferrous metal oxides, it is comminuted (preferably to 85% minus 200 mesh) and is mixed with comminuted (preferably 100% minus 65 mesh) high volatile, high ash waste coal and a non-gaseous sulfur material. Carbon content of the coal is 50% to 150% of the amount of carbon needed for stoichiometric complete reduction of nonferrous metal oxides in the ore and partial reduction of its iron oxide content. The sulfur content of the sulfur material is such that, together with the sulfur content of the coal, the weight of sulfur is 1% to 1.5% of the weight of the ore. The mixture, preferably pelletized with water, is heated out of contact with air to bring it to 550° C. (requiring 20 to 25 minutes) and is then passed to an aquatic quench. Volatiles in the coal provide reducing gas, and the ash content facilitates wet grinding after quench and provides a good filter bed for subsequent leaching to recover nonferrous metal values.

15 Claims, 2 Drawing Figures

SELECTIVE REDUCTION OF NICKEL LATERITE ORES

TECHNICAL FIELD OF THE INVENTION

This invention relates to the processing of nickel laterite ore for recovery of nonferrous metal values therefrom; and more specifically the invention concerns a method of preparing nickel laterite ore for selective reduction, and of selectively reducing the ore, and also relates to a product into which such ore is incorporated to prepare it for selective reduction.

BACKGROUND OF THE PRIOR ART

The ores that are herein referred to as nickel laterite ores are refractory oxidic ores of nickel. They include garnerite as well as limonitic and serpentitic ores. All of them are relatively low grade ores that also contain different but substantial proportions of iron oxides. Often cobalt in oxidic form is also present, and when it is present it is normally coextracted with nickel. Nickel laterite ores may also contain copper, but usually in such quantities that its extraction is not economically worthwhile except insofar as it may have to be accomplished for nickel and cobalt recovery.

A substantial amount of attention has been given to devising methods and processes that will enable the highest possible percentage of nickel (and cobalt when present) to be extracted from lateritic nickel ores at the lowest possible cost. Representative of the prior state of the art is U.S. Pat. No. 3,929,468, to R. E. Siemens et al, which identifies other patents and publications that relate to techniques for extracting valuable elemental metals from lateritic nickel ores. Further background information can be obtained from U.S. Pat. No. 3,903,241, to L. G. Stevens et al.

Both of the two patents just mentioned relate to processes wherein nickel laterite ore is treated in a reducing atmosphere at an elevated temperature that is so controlled as to selectively reduce the nickel and cobalt in the ore while preventing complete reduction of more than a small percentage of the iron oxide content. The hot reduced material is cooled in a reducing or inert atmosphere and is then subjected to hydrometallurgical treatment by which the nonferrous values are recovered. An early and basic disclosure of such a process is to be found in U.S. Pat. No. 1,346,175, to M. H. Caron, issued in 1920, and the two previously mentioned patents disclose improvements of the Caron process.

It has been known for some time that beneficial effects are obtained with the use of an additive in the selective reduction step that prevents the nickel from combining with iron components of the ore to form compounds from which metallic nickel cannot be readily recovered in a subsequent extraction step. A number of suitable additives are disclosed in the Stevens et al patent, including sulfur and various identified sulfur compounds. The Siemens et al patent discloses a process wherein crushed laterite ore is mixed with finely ground pyrite, and the mixture is pelletized prior to being subjected to selective reduction at an elevated temperature. A relatively large number of other prior patents have evidenced an appreciation of the benefits of the presence of sulfur during selective reduction. For example, several suggest the use of Bunker C (#6) oil as the reducing agent, the 1 to 5% sulfur content of such oil being recognized as desirable. There are also several prior patents which suggest that selective reduction of a bed of nickel laterite ore be accomplished by passing over the bed gases obtained from the heating of high sulfur low grade coal.

Althouth it is known that sulfur should be present during selective reduction, the role that it plays is not understood. The generally accepted theory is stated in the Siemens et al patent, namely that in those laterite ores containing any substantial amount of magnesia (above about 5%) the sulfur "inhibits the formation of insoluble nickel magnesium silicates formed during the later reduction." However, in research in connection with the present invention it has been found that the presence of sulfur during selective reduction is beneficial not only with serpentitic ores that have a high magnesium silicate content but also with limonitic ores that have a high iron oxide content and contain little or no magnesium silicate. It has also been found that sulfur in gaseous form is not as effective as sulfur in solid forms, whether solid sulfur or a sulfur compound such as pyrite.

In prior processes wherein coal was used with nickel laterite ore in a kiln, the ore was usually charged into the kiln, mixed with lumps of coal, and the kiln was heated internally, as by means of a fuel burner flame projected into one end of it. Because of poor contact between the ore and the coal, reduction of the nonferrous metal was incomplete and therefore extraction efficiency was poor, even though the ore remained in the kiln for as long as two to two and one-half hours. Furthermore, because of poor temperature control due to internal heating of the kiln, some combustion of the coal took place and the ore tended to fuse and stick to the kiln, so that there were high labor costs for kiln maintenance and clean-out.

In other selective reduction techniques that have been tried, ore and sulfides, with coke, coal or reducing gas, were charged to multiple hearth roasters. Control of the reduction process was difficult, and the retention times had to be fairly long so that many hearth units were required if a high rate of production was to be maintained.

Prior selective reduction techniques had the further significant disadvantages of requiring costly apparatus and having poor fuel efficiency. Thus, the above-mentioned Siemens et al patent taught that the ore had to be thoroughly dried at a minimum dehydration temperature of about 350° C. before reduction could begin. This required the provision of a drier in addition to the multiple hearth furnace in which reduction took place, and much of the heat expended in drying was inevitably lost. Further complications were entailed in cooling the ore after reduction, inasmuch as the reduced ores are pyrophoric even at ambient temperatures. Like other prior teachings, the Siemens et al patent directed that the ore be cooled in an inert atmosphere to below 200° C. before being brought into contact with water, to prevent reoxidization of the nonferrous metals, and here again special apparatus had to be provided for such cooling and little or none of the heat given of by the ore could be recovered.

The present invention is based upon the discovery that a material which otherwise has no economic value, and which is generally regarded as an undesirable by-product, namely high-sulfur, high-ash waste coal unsuitable for boiler combustion, can be used in the processing of nickel laterite ore to obtain very important but unforeseeable advantages, including facilitation of nonferrous metal extraction, increase in the percentage of nonferrous metal values extracted from a given amount or ore, and production of a final waste product that can be returned to the lateritic ore mine as a detoxified soil which is less objectionable from an evironmental standpoint than the ore originally taken from the mine.

Thus an object of the present invention is to beneficially utilize high sulphur, high ash waste coal which as heretofore been regarded as having no economic value or a negative economic value, by employing such waste coal in the processing of nickel laterite ore in such a manner as to provide for good control of selective reduction of the ore, reduce the cost of maintaining and cleaning out the kiln in which selective reduction is performed, enable a reduced ore product to be obtained that can be readily crushed to prepare it for a leaching operation, afford a crushed product that aids filtration of the fine leach residues after leaching, and ultimately present a spent ore waste product that is environmentally acceptable.

In general, therefore, it is an object of this invention to so employ otherwise worthless waste coal as to materially improve the economics of processing nickel laterite ore for the recovery of nonferrous metallic values therefrom and at the same time improve the environmental quality of the spent ore waste material from such processing.

Another object of the invention is to provide a nickel laterite ore product in pellet form, and a process of making such pellets, which product is well suited for feeding into a kiln for selective reduction at an elevated temperature.

A further object of this invention is to provide a process by which nickel laterite ore can be selectively reduced, which process is highly efficient from the standpoint of capital equipment required, labor cost, energy consumption and yield of nonferrous metal values.

More specifically, it is an object of this invention to provide a process by which nickel laterite ore can be selectively reduced without the need for a preliminary dehydration of the ore and wherein the presence of moisture in the ore is in fact beneficial, which process permits the ore to be cooled directly after reduction of immersion in an aqueous quench so that the heat energy in the steam thus generated can be readily recovered and utilized.

SUMMARY OF THE INVENTION

The objects of the invention are achieved by means of a pelleted product essentially comprising comminuted nickel laterite ore, comminuted high-volatile coal, and a comminuted solid state sulfur material, all in a uniform mixture, together with sufficient water for pelletization.

In the method aspect of the invention its objects are achieved by producing a uniform mixture of comminuted lateritic nickel ore, comminuted high volatile coal and a non-gaseous sulfur material; and, while substantially excluding air from the mixed material and maintaining particles of coal and ore in intimate contact with one another, supplying heat to the mixture to dirve off from the coal volatile components that provide a reducing atmosphere for the ore, sufficient heat being supplied to bring the mixture to a temperature at which the nonferrous metal oxides in the ore are substantially completely reduced but the iron oxides in the ore are reduced only partially. Thereupon the selectively reduced material is cooled out of contact with air and free oxygen. The material is preferably pelletized with water before heating. After cooling, the material is comminuted and subjected to a substantially conventional hydrometallurgical treatment for extraction of nonferrous metal values.

DETAILED DESCRIPTION OF THE INVENTION

Figure 1:
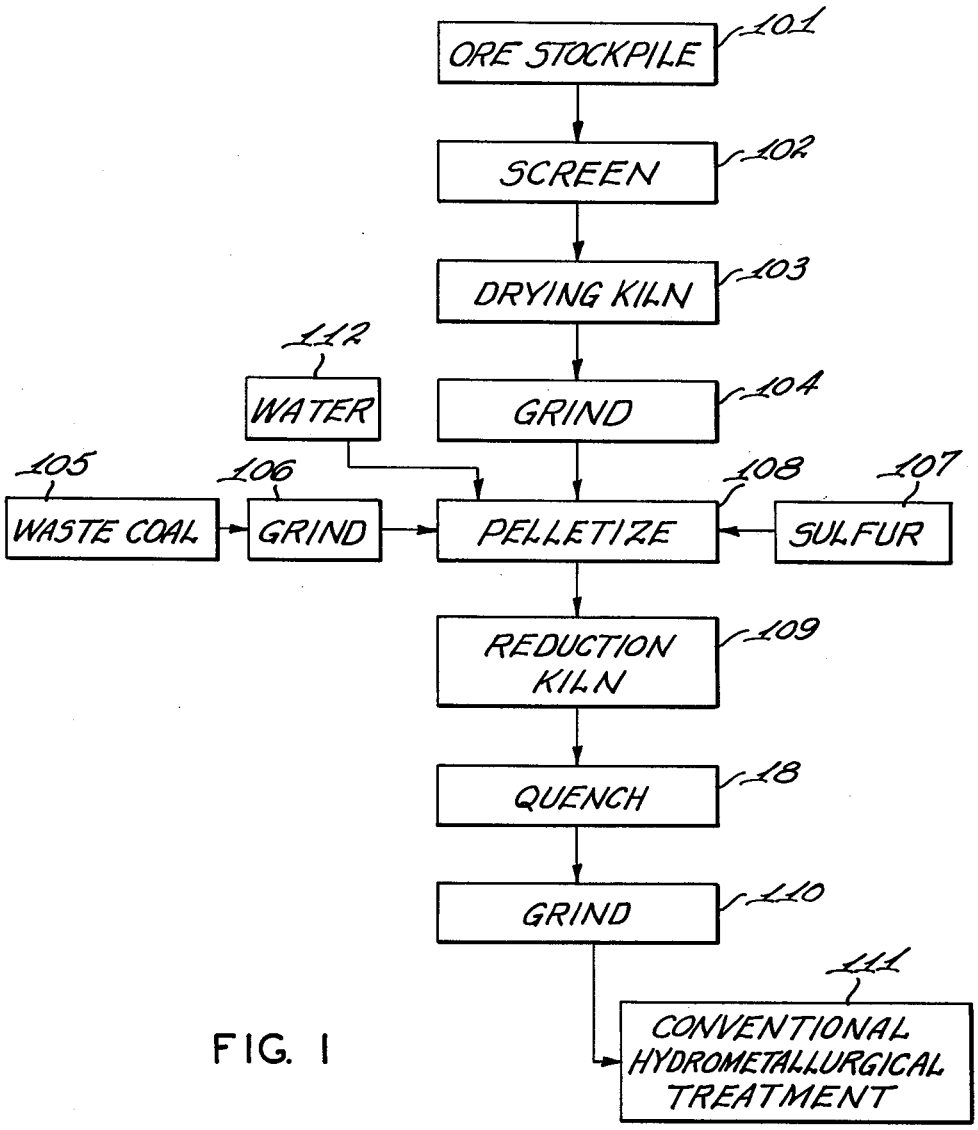
FIG. 1 is a flow chart showing the successive steps in a process that embodies the principles of this invention.

Nickel laterite ore to be processed according to the invention, whether garnerite, limonite, serpentite or a mixture of them, is taken from a stockpile 101 and screened as denoted by 102 in FIG. 1 to remove trash components. The screened ore is then dried, as by passing it through a drying kiln as denoted by 103, so that it can be readily ground or otherwise comminuted as indicated at 104. The particle size of the comminuted ore is preferably such that at least about 85% of it is minus 200 mesh. (All mesh sizes herein given are U.S. Tyler mesh.) There seems to be no lower limit on ore particle size, except such as may be dictated by economic considerations and requirements for dust control, but it appears that as ore particle sizes increase above 200 mesh, nonferrous metal extraction efficiency falls off. Thus reasonably good nickel extraction was obtained by the method of this invention with minus 6 mesh laterite ore, but the loss in extracted value more than offset the slightly higher cost of comminuting the ore to the preferred minus 200 mesh.

As indicated at 105–108, comminuted ore is thoroughly mixed with comminuted high volatile coal and with a non-gaseous sulfur material which can be comminuted solid sulfur or a comminuted sulfur compound, such as iron pyrite, and the mixture is pelletized with the addition of water as a binder. The pellets can be charged directly into a kiln 108 (described hereinafter) without being dried.

From the standpoint of cost, and for utilization of an otherwise worthless material, it is preferred that the high volatile coal be high ash waste coal (as designated by 105) such as is ordinarily washed out of mined coal and discarded because it is unfit for boiler and similar combustion. The high ash content that causes such waste coal to be unsuitable for other known purposes is advantageous in the process of this invention for reasons explained hereinafter. The coal should have a high volatile content, and therefore low grade peat and lignitic coal, as well as wood waste and wood by-products, are as suitable for the process as bituminous coal, all such materials being embraced by the term "coal" as used herein. Although it is not necessary that the coal have a high sulfur content, a high sulfur content is desirable from the standpoint of the process, and waste coal that has a high sulfur content is usually readily available and is considered especially undesirable for other purposes.

As indicated at 106, the coal is comminuted before being mixed with the ground ore, preferably to bring 100% of it to minus 65 mesh. Again, there is no objection to a smaller particle size, except for cost of grinding and possible dust control problems. As particle size increases above 65 mesh, the coal pelletizes less readily. It was found that minus 6 mesh coal, although it could be made to pelletize, did not afford as high a percentage of nonferrous metal recovery as more finely divided coal.

The amount of comminuted coal to be mixed with a given quantity of comminuted ore depends upon the carbon content of the coal. The theoretically desired amount of carbon is that which would be needed for stoichiometric partial reduction of the iron oxides in the ore and complete reduction of its nickel oxide content. By partial reduction of the iron oxides is meant reduction of the iron content of the ore from $Fe_2O_3$ to FeO, on the assumption that the entire iron oxide content of the ore is in the trivalent form ($Fe_2O_3$). For the purposes of this theoretical value it can be further assumed that the ore contains no cobalt or copper oxides. These assumptions are not necessarily in accord with the actual composition of the ore, but from a practical standpoint the discrepancies are of negligible significance because satisfactory results can be obtained if the carbon content of the coal is in the range of about 50% to about 150% of the theoretical value. Particularly good results have been obtained when the carbon content of the coal has been about 87% of the theoretical amount needed for stoichiometric complete reduction of the nonferrous metal oxides and partial reduction of the iron oxides in the ore.

The sulfur material that is mixed with the ore and coal, designated by 107, can be iron pyrite or any other inexpensive non-gaseous sulfur compound. Pure sulfur (flowers of sulfur) was successfully used in tests. The sulfur material, if in solid state, is comminuted to a particle size consistent with that of the coal and the ore, to permit it to be uniformly admixed and pelletized with those materials; or a water-soluble sulfur compound in proper quantity could be introduced into the ore-coal mixture in the water used for pelletizing. The optimum quantity of sulfur material was found to be such that the weight of its sulfur component, together with that of the sulfur component in the coal, was between 1% and 1.5% of the weight of the ore. A good value was found to be 1.2%. With decreasing amounts of sulfur, substantially decreasing portions of the available nickel content of the ore were obtainable. Increasing the amount of sulfur above the 1.5% level would neither increase nor decrease recovery of nickel values but would obviously be uneconomical because there would be no return for the additional cost. It will be evident that if high sulfur coal is available, its use is advantageous, since the amount of sulfur compound that must be supplied decreases in proportion to the sulfur content of the coal.

Pelletization, designated by 109, takes place in a conventional pelletizing apparatus, water being added to the mixture to the extent needed for pelletizing. It will be understood that the mixing of the comminuted materials can take place at the pelletizer, as shown at 108 on the flow chart, but is perferably accomplished ahead of the pelletizing apparatus to ensure thorough mixing. Inasmuch as nickel laterite ore is a clay-like material, the addition of water to it, as designated by 112, causes it to be cohesive; hence, no other binding agent is needed. Preferably about 23% to 30% (by weight) of water is added to the dry mixture, depending upon the dry material. Normally, the moisture content of the pellets will be ascertained, for purposes of control of heat input during selective reduction.

The pellets are preferably about ⅜ inch (10 mm.) to ¾ inch (20 mm.) in diameter but can vary from this value to a substantial extent, although if the pellets are too small they will prevent adequate gas flow through the bed in the kiln, and if they are too large there may not be uniform selective reduction all through every pellet, or a longer period of residence in the kiln will be required to allow all pellets to be heated through.

Although some of the benefits of the invention can be obtained by charging the mixed comminuted ore, coal and sulfur into a kiln without pelletization, it is necessary to agitate the mixture constantly and thoroughly in the kiln in order to get good gas penetration of the ore, to minimize dust control problems and to prevent the material from sticking to the kiln. From the standpoint of capital investment, efficiency of extraction, and simplicity of control of selective reduction, pelletication is preferred.

Figure 2:
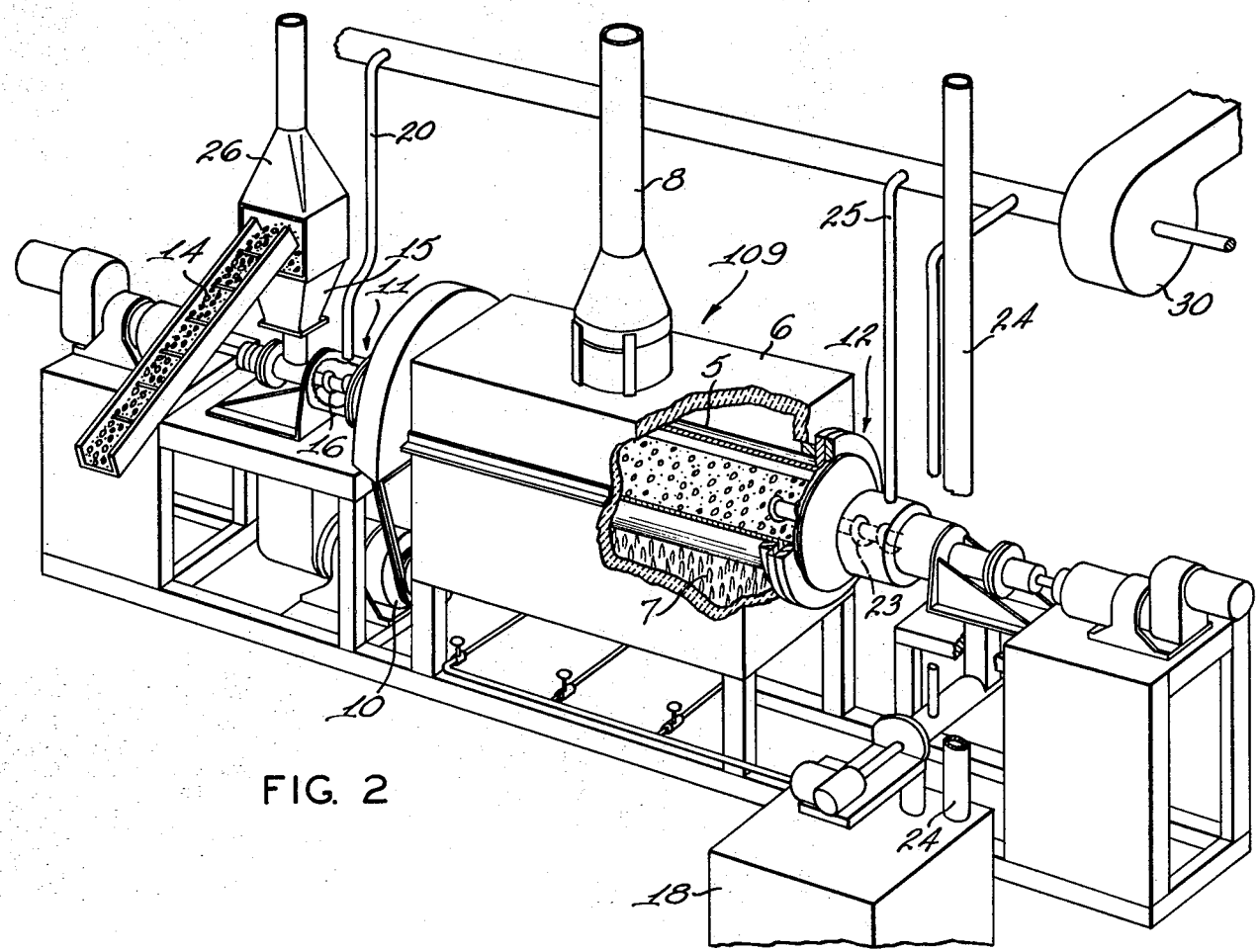
FIG. 2 is a perspective view, with portions broken away, of a rotary kiln that can be used for the selective reduction or ore according to the method of this invention.

FIG. 2 illustrates a suitable type of rotary kiln 109 in which selective reduction can be effected in accordance with the method of this invention. The kiln comprises an elongated cylindrical roasting chamber 5 that is rotatable within a fire box 6. The chamber 5 is externally heated by suitable fuel such as a gas burner 7 or a bed of coal in the bottom of the fire box 6. It will be understood that suitable means must be provided for controlling combustion of the fuel burner 7 in order to afford close control of the temperature in the interior of the roasting chamber 5. Combustion gases from the burning fuel are not permitted to enter the roasting chamber 5 but instead flow upwardly around the exterior of the chamber in passing to a stack 8 that opens from the top of the fire box. The cylindrical chamber 5 is rotated about its axis as by means of an electric motor 10 mounted adjacent to one of its ends. The chamber 5 is inclined downwardly from an inlet end 11 thereof to its discharge end 12 so that material is advanced through the chamber by gravity as the chamber rotates.

Pellets to be treated in the kiln are fed into it as by means of a belt conveyor 14 feeding into a hopper 15. A hood 26 over the hopper leads to a dust collector (not shown). From the hopper the pellets are steadily fed into a coaxial inlet port in the inlet end of the chamber 5, as by means of a worm conveyor 16.

As the pellets are heated and the volatile components are driven off from the coal, such components fill the interior of the chamber 5 as a reducing gas. To permit air to be driven out of the roasting chamber by the reducing gas, and to relieve the build-up of such gas in the chamber, the chamber is vented as explained hereinafter. The vented reducing gas has some fuel value and can therefore be conducted back to the bottom of the fire box 6 to be utilized for heating the roasting chamber 5.

With the method of this invention, in contrast to the selective reduction procedure disclosed in the abovementioned Siemens et al patent, there is no necessity for the material entering the kiln to be dry; and in fact very successful results have been consistently obtained when pellets having up to a 24% moisture content were fed directly into the roasting chamber 5. At the temperature prevailing in the kiln, and in the presence of the carbon in the coal, which is uniformly dispersed through the entire bed of material in the kiln, the water apparently breaks down chemically to a certain extent, and its hydrogen component enters into the composition of the reducing gas, so that the presence of the water seems to be beneficial.

The temperature in the roasting chamber 5 should not exceed 650° C. and the preferred maximum is 550° C. Control of the combusting fuel bed 7 must be maintained with regard for the fact that some heat is generated by the reduction process occurring in the chamber 5. When the temperature of the incoming pellets reaches about 350° C., they have lost most of their inherent crystalline moisture content and selective reduction begins. The temperature of the material thereafter rises steadily as it progresses through the kiln, and the selective reduction process is completed when the temperature of the material attains 550° C. Hence the time of residence in the kiln is so controlled that as soon as the material has reached 550° C., it is discharged from the kiln and its cooling begins. By thus avoiding prolonged exposure of the ore to high temperatures, the nickel content of the ore is prevented from entering into insoluble nickel-magnesium silicates. Because small particles of coal and ore are in intimate contact with one another all through each pellet, the ore is substantially completely exposed to the carbon of the coal and to the reducing gases driven of from the coal, and the reducing atmosphere permeates all portions of the bed of pellets. Selective reduction thus occurs both completely and rapidly, so that any particular pellet need be in the kiln for only 20 to 25 minutes, as compared to residence times of two to two and one-half hours that were common with prior processes.

As the material issues from a concentric discharge port in the discharge end 12 of the chamber 5, it is conducted out of contact with air, as by a second worm conveyor 23, directly to a water or ammoniacal solution quench 18. Some cooling of the material takes place as it moves from the kiln to the quench, but it can enter the quench as soon after leaving the kiln as is expedient. Apparently the carbon of the coal, uniformly dispersed through the ore and in intimate contact with particles of reduced nonferrous metal, acts as a barrier during the quench to prevent reoxidization of such metal. The steam resulting from the quench can be conducted (as by means of a duct 24) to a location at which a subsequent leaching operation is performed so that the heat content of the steam can be efficiently utilized to heat the leach slurry and thus facilitate hydrometallurgical extraction of nickel and cobalt; or it can be used in some other process step such as ammonia stripping. A certain amount of reducing gas is evolved as the material moves from the kiln to the quench and some of it can be carried away with the steam.

Vents 20 and 25, communicated with the respective housings for the infeed worm conveyor 16 and the discharge worm conveyor 23, provide for relief of the overpressure of reducing gas in the roasting chamber 5. A small suction fan 30 can be connected with the vents 20 and 25 to draw the gas through the pellets at the inlet and outlet of the chamber and to drive the gas to the gas burner 7 or to some other point of use or disposal.

It will be observed that processing through the kiln and quench can be continuous so that high production volume can be maintained with a single kiln.

After quenching, the cooled material is wet ground, as designated by 110, in preparation for subsequent generally conventional hydrometallurgical processing 111. Because volatile components have been driven out of the coal during passage of the pellets through the kiln, and because of the high ash residue in the pellets, they are porous and friable so that the grinding operation 110 can be accomplished with a low expenditure of energy. The pellets are of moderate to high strength and are relatively dust free, dust loss being on the order of 2%.

Since the procedures 111 that are subsequent to grinding can be conventional, they need not be described. However, it might be mentioned that because of the high ash content of the material, it tends to form a good filter bed during leaching, and, as pointed out above, the spent material is non-polluting.

The following are specific examples of practice of the method of this invention.

EXAMPLE 1

A 1625 lb. (738.63 kg.) batch of dried nickel laterite ore, comminuted to minus 200 mesh, was mixed with 194.2 lbs. (88.27 kgs.) of high sulfur, high ash, high volatile coal, also comminuted to minus 200 mesh, and with 15.41 lbs. (7 kgs.) of powdered sulfur. These materials were mixed before being pelletized, and 292 lbs. (132.73 kgs.) of water was used for pelletization. Pellets ranged in size from ⅜ inch (10 mm.) to ¾ inch (20 mm.). With no attempt to dry the material it was put through a kiln like that described above, with a temperature of 550° C. maintained in the roasting chamber. A feed rate of 3 to 5 lbs. (1.36 to 2.27 kgs.) per minute was maintained, so that every pellet remained in the kiln for 20 to 25 minutes. The elapsed time for processing the batch through the kiln was 9.28 hours. The material issuing from the kiln was passed directly to an aquatic quench.

After cooling substantially to ambient temperature in the quench, the selectively reduced material was finely comminuted by grinding and was subjected to an ammonia-based leaching process. It was found that 57% of the nickel value of the ore was extracted.

In considering this rather low extraction efficiency, it should be observed that the test was intended to include coal in an amount such that the carbon content of the coal would be 150% of the theoretical amount of carbon required for stoichiometric complete redection of the nonferrous metal oxides in the ore and partial reduction of its iron oxides, and that the actual carbon content of the coal was found to be about 225% of this theoretical value. As appears from the next two examples, a substantially lower proportion of coal produces a higher nickel yield.

EXAMPLE 2

A 1970 lb. (895.45 kg.) batch of nickel laterite ore, dried and comminuted to minus 200 mesh, was mixed with 162 lbs. (73.64 kgs.) of high sulfur, high ash, high volatile coal, likewise comminuted to minus 200 mesh, and with 28.52 lbs. (12.96 kgs.) of comminuted powdered sulfur. Mixing and pelletizing with 418 lbs. (190 kgs.) of water were accomplished as in Example 1, and again the pellets were processed through a kiln without drying, at the temperature and rate specified in Example 1, 13.28 hours being required to process the batch through the kiln. The material issuing from the kiln was quenched, ground and subjected to leaching, as in Example 1, and in this case 76.9% of the nickel in the ore was recovered. Apparently the higher nickel recovery was owing to the carbon content of the coal being only 155% of the theoretical value discussed above.

EXAMPLE 3

In this case, 1574 lbs. (715.45 kgs.) of dried nickel laterite ore was mixed and pelletized with 79 lbs. (35.91 kgs.) of high sulfur, high volatile, high ash coal and with 11.83 lbs. (5.38 kgs.) of powdered sulfur, the ore and coal again being comminuted to minus 200 mesh, and mixing and pelletizing being accomplished as before. Without drying it, the material was processed through the same kiln used in Examples 1 and 2, under the same conditions, and was in the same way quenched, comminuted and subjected to leaching. The carbon content of the coal was 87.3% of the theoretical quantity required for stoichiometric complete reduction of the nonferrous metal oxides and partial reduction of the iron oxides; and 82.8% of the nickel content of the ore was recovered.

EXAMPLE 4

In this case, the ore was not pelletized and was comminuted to minus 6 mesh. The tested batch of ore weighed 856 lbs. (389.09 kgs.) and was mixed with 79 lbs. (35.91 kgs.) of coal, also comminuted to minus 6 mesh, and with 11.8 lbs. (5.36 kgs.) of powdered sulfur. The approximate moisture content of the material entering the kiln was 12%. The material was processed through the same kiln and quench employed for Examples 1 through 3, and processed through the kiln and subsequent treatment in the same manner. No difficulty was experienced in feeding the material through the kiln. In this case, 74.54% of the nickel in the ore was extracted.

It will be apparent that this invention provides an efficient and inexpensive method for selective reduction of nickel laterite ores to prepare them for hydrometallurgical treatment, which method can utilize as a source of reducing gas a material that otherwise has no economic value, and provides such further significant benefits as substantially faster selective reduction than prior processes, higher recovery of nonferrous metal values in the ores and facilitation of the treatments that follow selective reduction.

The embodiments of the invention in which an exclusive property or privilege is claimed are defined as follows:

1. A process for extracting nonferrous metals from nickel laterite ore by a selective reduction treatment that causes the nonferrous metal oxide components of the ore to be reduced but effects substantially only partial reduction of the iron oxide components, and a subsequent hydrometallurgical treatment by which the nonferrous metals are leached out of the reduced ore, characterized by:

A. preparing the ore for selective reduction treatment by
  (1) comminuting it (104), and
  (2) forming a mixture (as at 108) of the comminuted ore with
    (a) comminuted high volatile sulfur containing coal (105, 106) and
    (b) a non-gaseous sulfur material added in an amount such that the total weight of the sulfur present including the sulfur in the coal, is between 1% and 1.5% of the weight of the ore; and B. while
  (1) maintaining particles of ore and coal in intimate contact with one another and
  (2) substantially preventing air and free oxygen from having access to the mixture, supplying sufficient heat to the mixture (109) to drive off volatile components from the coal, so that they provide a reducing atmosphere for the ore, and to bring the mixture to a temperature at which the nonferrous metal oxides in the ore are substantially completely reduced but the iron oxides in the ore are reduced only partially.

2. The process of claim 1, further characterized by:
C. while substantially excluding air from the heated material, conveying it into an aquatic quench (18).

3. The process of claim 1, further characterized by:
before heating the mixture, pelletizing it (108) with water.

4. The process of claim 1, further characterized by:
cooling the mixture (as at 18) when its temperature reaches about 550° C., while continuing to prevent air and free oxygen from having access to the mixture.

5. A process for extracting nonferrous metals from nickel laterite ore by selectively reducing the ore with a heat treatment that causes substantially complete reduction of the nonferrous metal oxide components of the ore but substantially only partial reduction of its iron oxide components, and thereafter subjecting the reduced ore to hydrometallurgical treatment (111) by which the nonferrous metals are leached out of it, characterized by:

A. comminuting (104) the nickel laterite ore;
B. forming a substantially uniform mixture of the comminuted ore
  (1) with comminuted high volatile sulfur containing coal (105, 106) and
  (2) with a non-gaseous sulfur material (107) added in an amount such that with the weight of the sulfur content of the coal, the total weight of the sulfur is between 1% and 1.5% of the weight of the ore;
C. by the addition of water (112) to the mixture, agglomerating (108) the mixture into pellets;
D. charging the pellets into a chamber (109) from which air is substantially excluded;
E. raising the temperature (as by 7) of the pellets in the chamber to a value at which reduction of nonferrous metal oxides in the ore is substantially complete but at which iron oxides in the ore remain substantially incompletely reduced; and
F. when the temperature of the mixture has reached said value, passing the mixture, substantially out of contact with air, from the chamber to an aquatic quench (18).

6. The process of claim 5, further characterized by:
(1) the nickel laterite ore being comminuted to a particle size not larger than 6 mesh, and
(2) the coal being comminuted to a particle size not larger than 6 mesh.

7. The process of claim 6 wherein:
(1) the particle size of the comminuted nickel laterite ore is such that a major portion thereof is minus 200 mesh, and
(2) the particle size of the comminuted coal is no larger than 65 mesh.

8. The process of claim 5 wherein the ratio of comminuted coal to comminuted ore in said mixture is such that the carbon content of the coal is within the range of 50% to 150% of the amount of carbon needed for stoichiometric complete reduction of the nonferrous metal oxide components in the ore and partial reduction of its iron oxide components.

9. The process of claim 5, wherein said process is continuous, further characterized by:

G. rotating said chamber (as by 10) about an axis to agitate the pellets;

H. feeding pellets into one axial end (11) of said chamber and discharging heated pellets towards said aquatic quench (18) from the opposite end (12) of the chamber; and I. externally heating said chamber (as by 7).

10. The process of claim 5 wherein the mixture is passed out of said chamber before its temperature exceeds 650° C.

11. The process of claim 10 wherein the mixture is passed out of said chamber when its temperature attains substantially 550° C.

12. The process of claim 5 wherein said high volatile coal is a high ash coal.

13. The process of claim 12 wherein said coal is high sulfur bituminous waste coal.

14. The process of claim 5 wherein the pellets are charged into said chamber (109) in substantially moist condition.

15. A pellet containing nickel laterite ore, said pellet being suitable to be heated in an enclosure from which air is substantially excluded, for selective reduction by which nonferrous metal oxides in the ore are substantially completely reduced and iron oxide components are substantially no more than partially reduced, and which pellet, after cooling, can be readily comminuted and thereafter subjected to a hydrometallurgical treatment for extraction of nonferrous metal values, said pellet being characterized by:

A. the nickel laterite ore being in particles, a substantially major portion of which are of minus 200-mesh size;

B. high ash, high volatile and sulfur containing coal
(1) in particles that are all of minus 65-mesh size,
(2) said coal being in such proportion to the ore that the carbon content of the coal is at least sufficient for stoichiometric complete reduction of the nonferrous metal oxides in the ore, and
(3) the coal particles being substantially uniformly mixed with the ore particles;

C. non-gaseous sulfur material substantially uniformly mixed with the ore particles and having a sulfur content such that, together with the weight of the sulfur content in the coal, the weight of sulfur is between 1% and 1.5% of the weight of the ore content of the pellet; and D. water in an amount to physically bind the particles of ore, coal and sulfur material.

* * * * *